US006176357B1

(12) United States Patent
Kuo

(10) Patent No.: US 6,176,357 B1
(45) Date of Patent: Jan. 23, 2001

(54) SUPPORT MECHANISM FOR A RETRACTABLE HANDLE OF A WHEELED LUGGAGE

(75) Inventor: Chung-Hsie Kuo, Pan-Chiao (TW)

(73) Assignee: Chaw Khong Technology Co., Ltd., Taipei (TW)

( * ) Notice: Under 35 U.S.C. 154(b), the term of this patent shall be extended for 0 days.

(21) Appl. No.: 09/339,857

(22) Filed: Jun. 25, 1999

(30) Foreign Application Priority Data

Feb. 2, 1999 (TW) ..... 88201726

(51) Int. Cl.[7] ..... A45C 3/279
(52) U.S. Cl. ..... 190/18 A; 190/115
(58) Field of Search ..... 190/18 A, 115, 190/124, 126, 127; 76/113.1; 280/47.315, 47.371, 655, 655.1

(56) References Cited

U.S. PATENT DOCUMENTS 5,431,428 * 7/1995 Marchwiak et al. ..... 190/18 A
5,653,000 8/1997 Lee .
5,653,319 * 8/1997 Wang ..... 190/18 A
5,685,402 * 11/1997 Lin ..... 190/115
5,782,325 * 7/1998 O'Shea et al. ..... 190/18 A
5,865,281 * 2/1999 Wang ..... 190/115
5,918,710 * 7/1998 Sher ..... 190/18 A

FOREIGN PATENT DOCUMENTS 241474 2/1995 (TW) .

* cited by examiner

*Primary Examiner*—Allan N. Shoap
*Assistant Examiner*—Tri M. Mai
(74) *Attorney, Agent, or Firm*—Dougherty & Troxell

(57) ABSTRACT

A base support mechanism for a retractable handle of a wheeled luggage is disclosed. The base support mechanism comprises a base support disposed on an exterior of the luggage body and an inner plate provided on an interior of the luggage body wherein the inner plate has a pair of openings, the luggage body has a pair of openings provided on the lower portion, the base support includes a horizontal portion and a vertical portion having a pair of sockets provided on an inner side thereof. Each socket is inserted through a corresponding opening of the luggage body and a corresponding opening of the inner plate. The bottom of the support tube is further inserted into the socket. Thereafter, the support tube is secured to the socket. Finally, one wheel is secured to a side of the inner plate and the other wheel is secured to an opposite side of the inner plate for finishing the assembly of a protection device onto the luggage.

6 Claims, 6 Drawing Sheets

SUPPORT MECHANISM FOR A RETRACTABLE HANDLE OF A WHEELED LUGGAGE

BACKGROUND OF THE INVENTION

1. Field of the Invention

The present invention relates to a support mechanism for a retractable handle of a wheeled luggage for protecting the bottom thereof.

2. Description of Related Art

Typically, a wheeled luggage comprises a luggage body made of fabric or plastic material, a handle grip assembly, a pair of parallel sliding tubes provided on a side of the luggage, a pair of support tubes for receiving the sliding tubes and allowing the sliding tubes to slide therein, a bezel assembly for securing the support tubes, a base support, and a pair of wheels provided on a side of the bottom of the luggage wherein the base support is provided on the interior of the luggage and is in cooperation with an outer plate for securing the bottom portions of the support tubes therebetween by means of, for example a plurality of screws or bolts, and each wheel is secured onto the bottom of the luggage by means of a stand.

This conventional wheeled luggage can be found in, for example, U.S. Pat. No. 5,653,000 and Taiwanese Publication No. 241,474 (announced on Feb. 21, 1995). They are advantageous being possibly fabricated from commercial available components. However, such wheeled luggage are disadvantageous for the following reasons:

1) Tedious and time-consuming in the assembly process.

2) Monotony in form.

3) The bottom of the luggage, including the portions near the wheels and the portion between the wheels, is subjected to be damaged when the luggage is in contact with other sharp objects, such as moved on the ground.

It is thus desirable to provide a protection device for preventing such portions from being damaged by e.g., scraping.

A couple of designs for providing such protection device have been located in a search as follows:

Taiwanese Publication No. 205,651 (Application No. 81,216,373) discloses a handle grip assembly for a retractable handle of a wheeled luggage wherein a protection device for a support is provided. It is designed to mold each bottom of the support tubes to be a flat part in order to be secured onto the outer surface of an L-shaped stand by means of rivets or bolts. However, this is unsatisfactory for being inconvenient in assembly, and the width of the protection device is simply slightly larger than that of the support tube. As such, it is difficult to enlarge the width of the protection device. Even if the width of the protection device is enlarged, the assembly process is further tedious.

Taiwanese Publication No. 331,096 (Application No. 86,218,980) discloses an improvement base support mechanism for a retractable handle of a wheeled luggage, and Taiwanese Publication No. 341,075 (Application No. 87,204,434) discloses an improvement device for stabilizing a base support mechanism for a retractable handle of a wheeled luggage. Both are simple in construction, and easy in assembly. However, these two designs are unsatisfactory for having a pair of exposed for securing the support tubes and the base support. In other words, the securing elements are not received within the luggage, and thus, the whole luggage is somewhat ugly in its appearance although the construction of the base support is improved.

Accordingly, the need remains for an improved and satisfactory base support mechanism for a retractable handle of a wheeled luggage in order to overcome the above drawbacks of prior art.

SUMMARY OF THE INVENTION

It is an object of the present invention to provide a base support mechanism for a retractable handle of a wheeled luggage for protecting the bottom thereof.

It is another object of the present invention to provide a base support mechanism for a retractable handle of a wheeled luggage wherein the support tubes are received within the luggage body, and an inner plate is secured to the base support between two wheels for enabling the wheels, the support tubes, and the base support to form an integral whole. This base support is simple in construction, easy to assemble, and thus a protection to the base support is feasible.

The advantages of the present invention are realized by providing a base support mechanism which comprises a base support disposed on an exterior of the luggage body and an inner plate provided on an interior of the luggage body wherein the inner plate has a pair of openings, the luggage body has a pair of openings provided on the lower portion, the base support includes a horizontal portion and a vertical portion having a pair of sockets provided on an inner side thereof. Each socket is inserted through a corresponding opening of the luggage body and a corresponding opening of the inner plate. The bottom of the support tube is further inserted into the socket. Thereafter, a securing element is employed to secure the support tube to the socket. Finally, one wheel is secured to a side of the inner plate and the other wheel is secured to an opposite side of the inner plate for finishing the assembly of a protection device onto the luggage.

The above and other objects, features and advantages of the present invention will become apparent from the following detailed description taken with the accompanying drawings.

DETAILED DESCRIPTION OF THE INVENTION

Figure 1A:
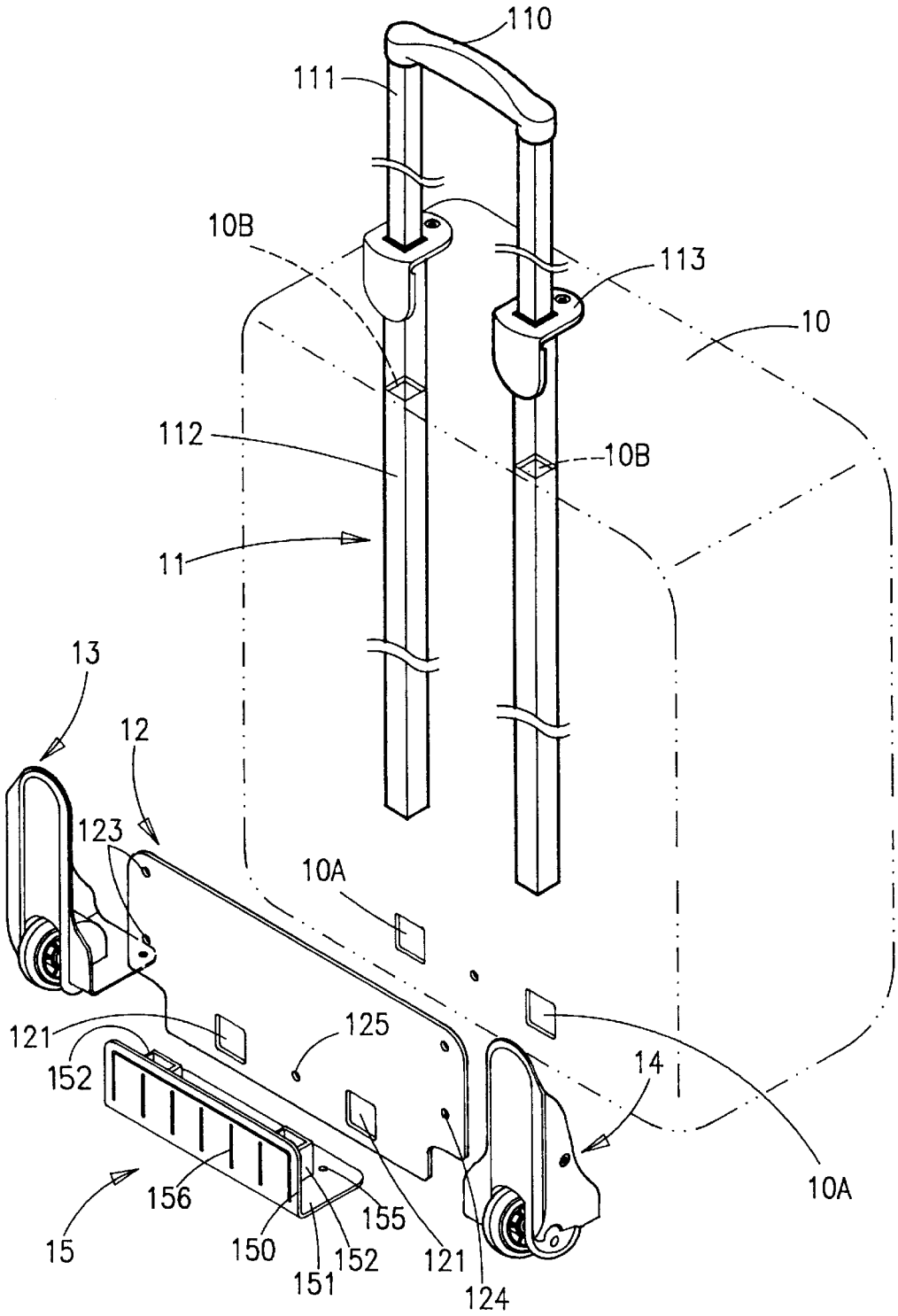
FIG. 1A is a perspective view of the present invention in part exploded in the lower portion of the luggage.
Figure 1B:
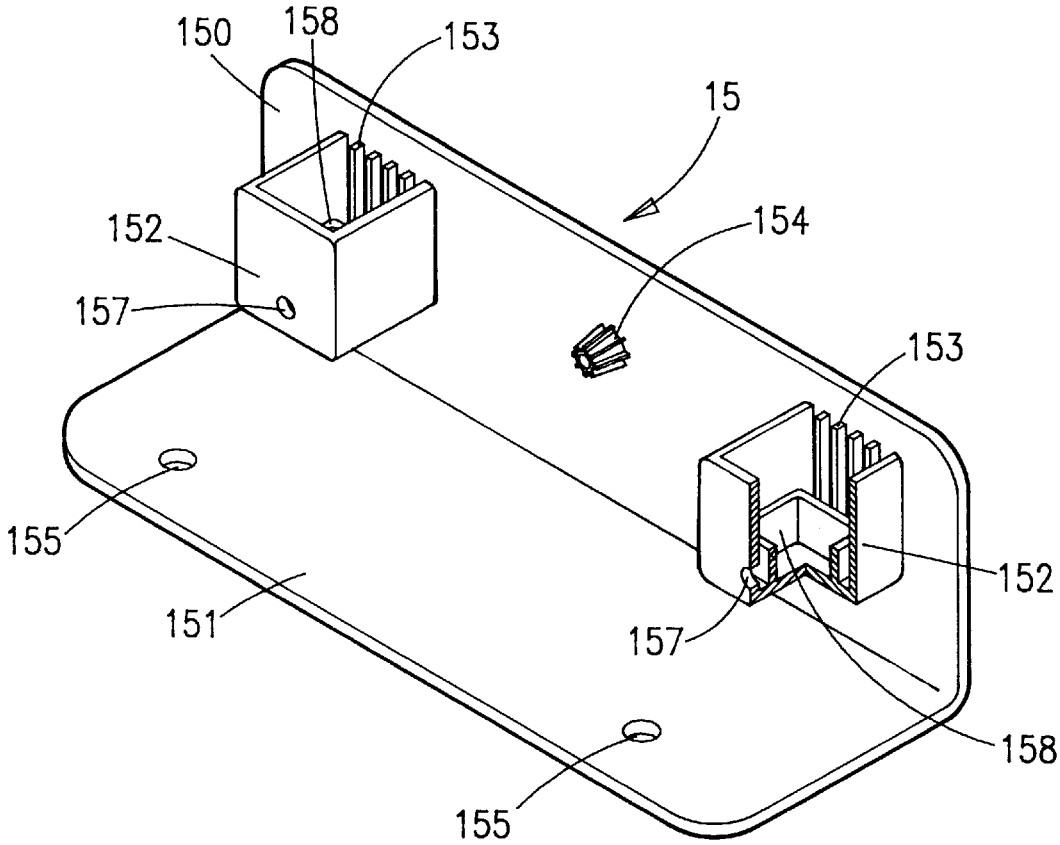
FIG. 1B is a perspective view of the base support in part section.
Figure 2:
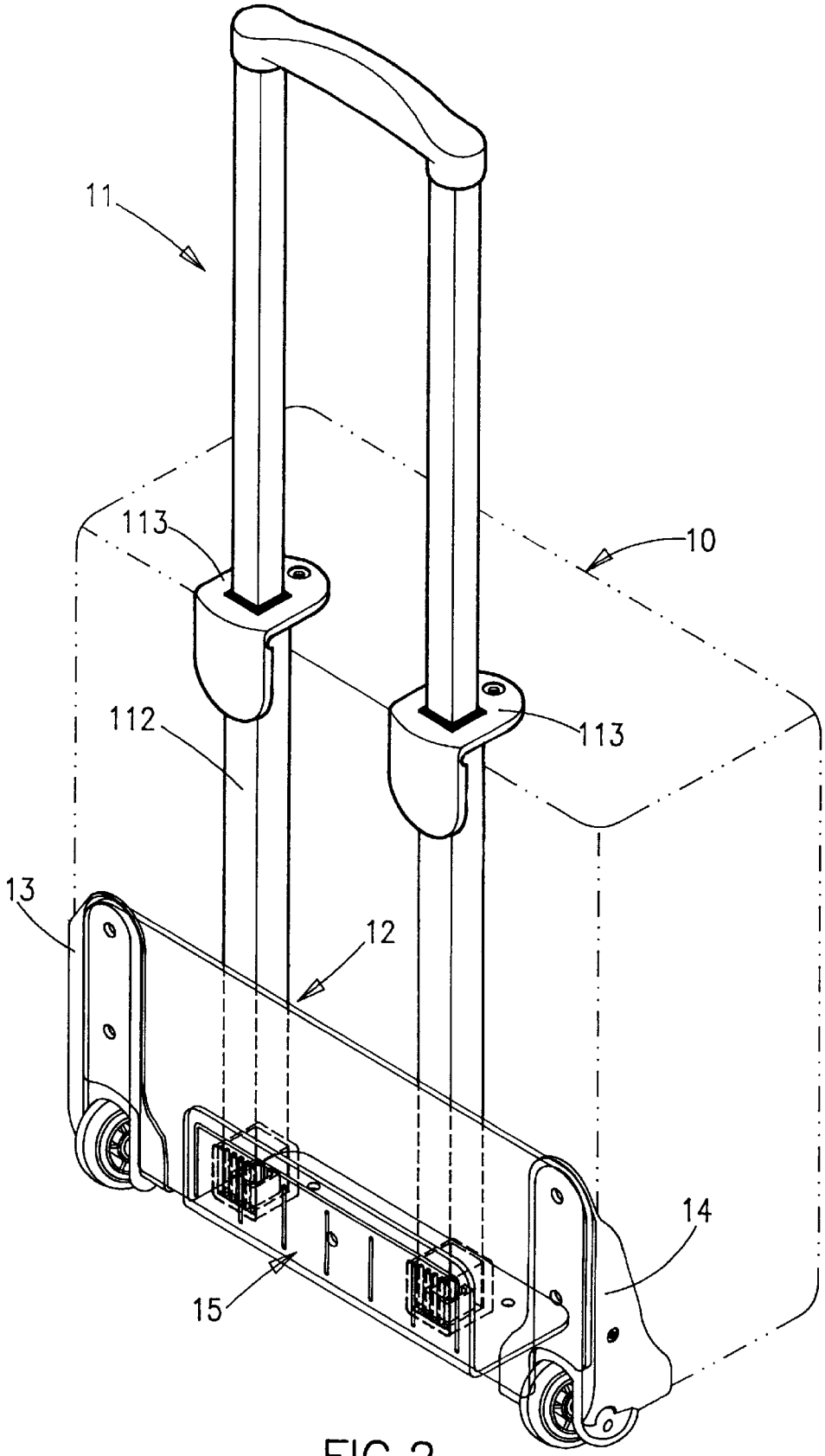
FIG. 2 schematically illustrates the assembled luggage.
Figure 3:
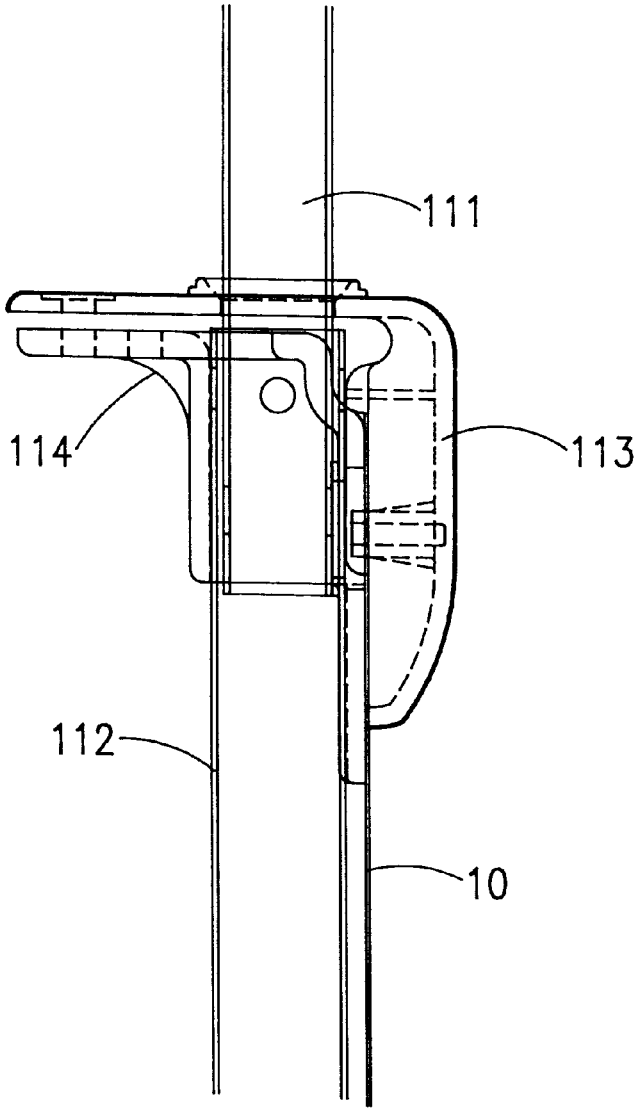
FIG. 3 is cross-sectional view of the bezel assembly of the present invention.

Referring to FIGS. 1A, 1B, 2, and 3, there are shown a wheeled luggage constructed in accordance with the present invention. The luggage generally comprises a luggage body 10, a handle grip assembly 110, a pair of parallel tubes 11 each provided on an end portion of the handle grip assembly 110 including a pair of sliding tubes 111 and a pair of support tubes 112 for receiving the sliding tubes 111 and allowing the sliding tubes 111 to slide therein, a wide inner plate 12, a pair of wheels assemblies 13 and 14, and a base support 15. As stated above, the luggage body 10 is made of fabric or plastic material. A pair of spaced openings 10A are provided on the lower portion of the luggage body 10. A pair of openings 10B each is provided on the top of the luggage body 10 in which the opening 10B is corresponding to a bezel base 114. The top of the support tube 112 is secured within the opening 10B. Note that the bezel base 114, as shown in FIG. 3, is received within the luggage body 10. A pair of L-shaped bezel covers 113, corresponding to the bezel bases 114, are provided on the top surface of the luggage body 10. The L-shaped bezel covers 113, the shell of the luggage body 10, and the bezel bases 114 are threaded together such that the bezel bases 114 may be firmly secured to the luggage body 10.

The improvement of the present invention is detailed as follow:

The base support 15 is provided on the exterior of the luggage body 10, while the inner plate 12 is provided on the interior of the luggage body 10 having two pair of holes 123 and 124 each including two holes. The base support 15 comprises a horizontal portion 151 and a vertical portion 150 having a pair of sockets 152 provided on an inner side thereof. The sockets 152 are of generally square in cross-section. The bottoms of the sockets 152 are not in contact with the horizontal portion 151. A pair of spaced openings 10A, each corresponding to a socket 152, are provided on a side of the luggage body 10, while a pair of spaced openings 121, each corresponding to a socket 152, are provided on the inner plate 12. Thus, each socket 152 is allowed to be inserted through the opening 10A and the opening 121 for being secured to the support tube 112 by means of a screw 157A (see FIG. 4 for further description).

It is shown that the width of the base support 15 is approximately equal to the distance between the wheels 13 and 14. One side of the inner plate 12 is secured to the wheel 13, while the other side of the inner plate 12 is secured to the wheel 14. In detail, the pairs of holes 123 and 124 are employed to allow screws (not shown) to thread through the holes 123, 124 and the inner plate 12 for securing the wheels 13 and 14 with the inner plate 12. Further, the width of the inner plate 12 is approximately equal to the distance between the wheels 13 and 14. Thus, the front lower portion of the luggage body 10, i.e., the portion between the wheels 13 and 14, are covered by the base support 15. In other words, such portion is protected by the base support 15 for preventing the luggage body 10 from being damaged by e.g., scraping. Furthermore, the appearance of the luggage body 10 will be kept good for a relatively long time if the base support 15 is made of durable material.

Figure 5:
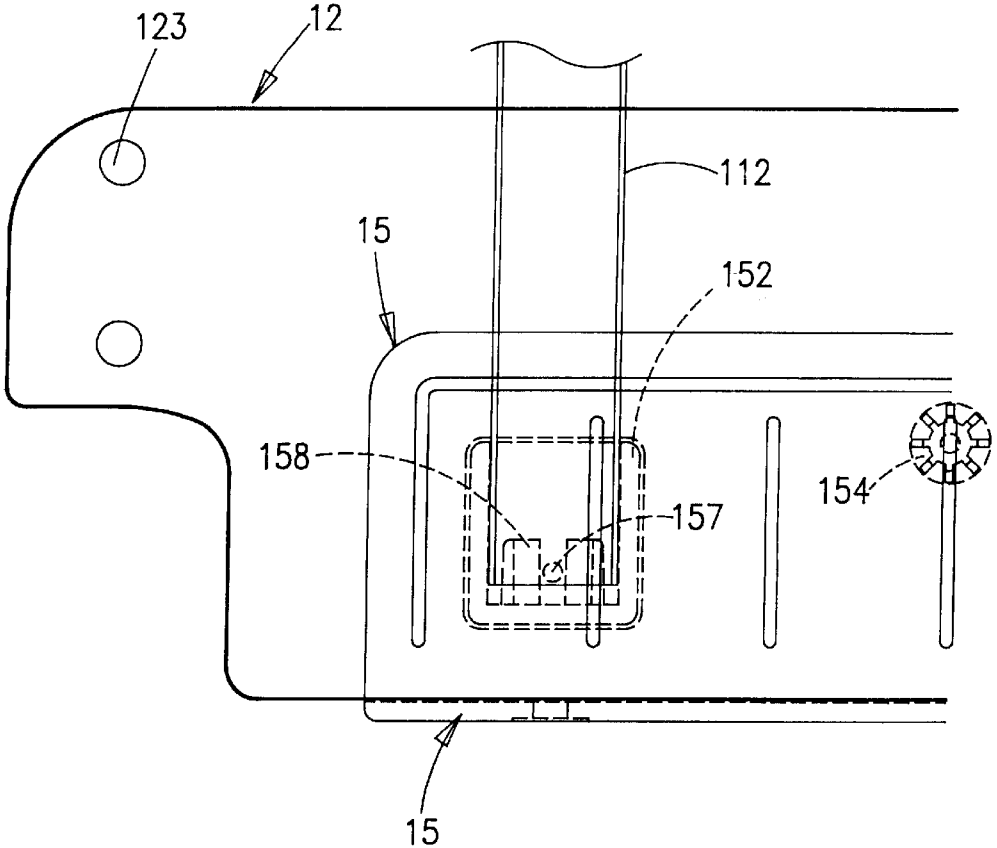
FIG. 5 is front plan view of the assembled portion of the bottom of the luggage.
Figure 4:
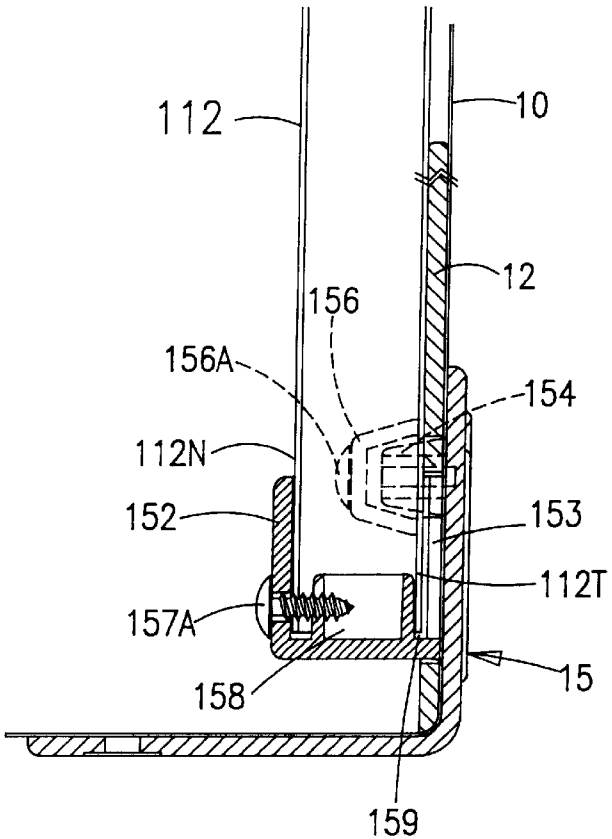
FIG. 4 is a cross-sectional view of the assembled portion of the bottom of the luggage.
Figure 6A:
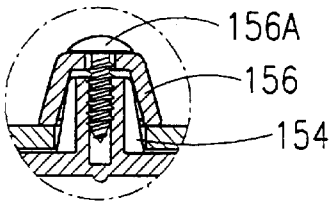
FIG. 6A is a partial cross sectional view of FIG. 6.
Figure 6:
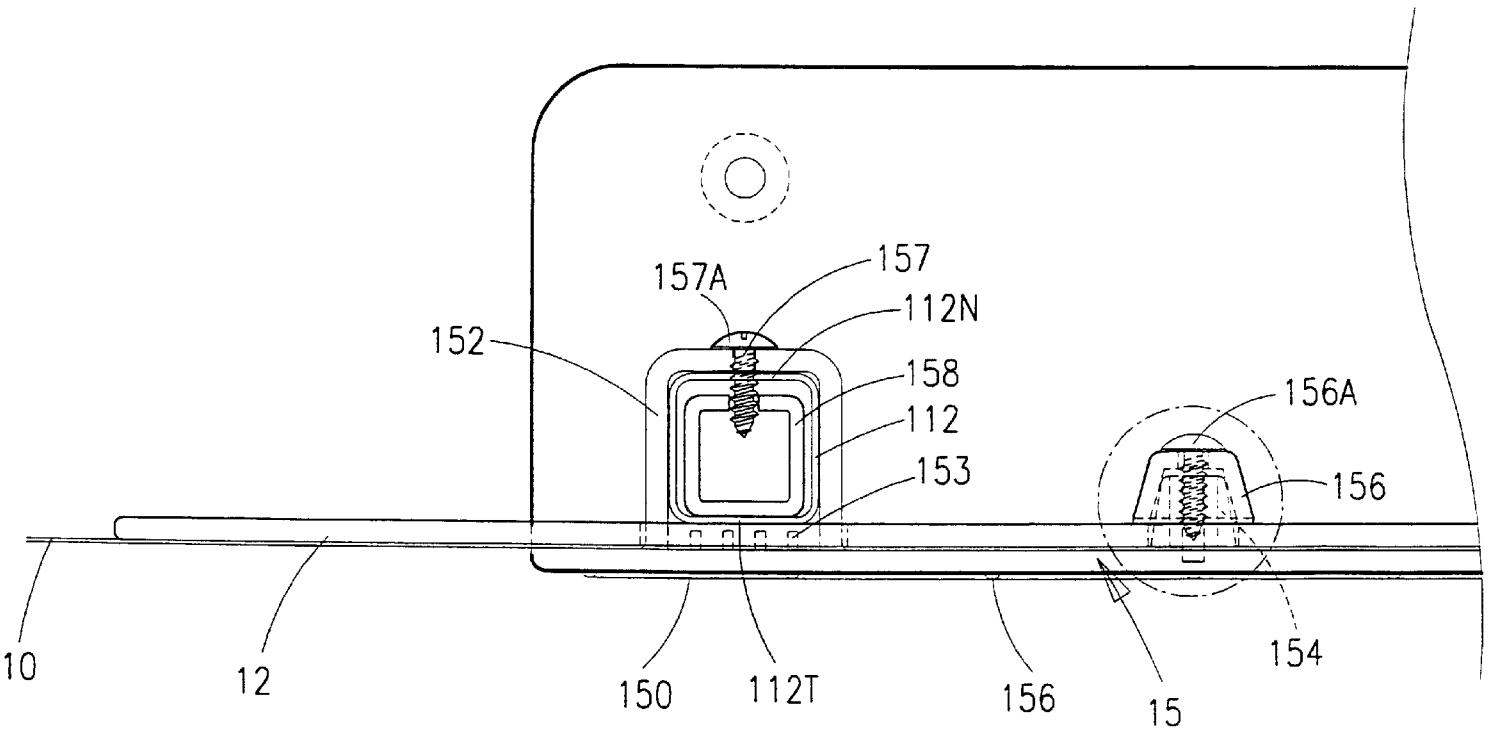
FIG. 6 is a top plan view of the assembled portion of the bottom of the luggage.

As shown in FIGS. 4–6, the socket 152 is only open on the top side. A vertical member 158 within the socket 152 is vertically protruded from the bottom thereof (see FIG. 1B). The height of the vertical member 158 is lower than that of the socket 152. A plurality of ribs 153 are provided on an inner side of the socket 152 in which the ribbed side of the socket 152 is formed on the vertical portion 150. A gap 159 is formed between a side of the vertical member 158 and the ribbed side of the socket 152. The width of the gap 159 is approximately equal to the thickness of the wall of the support tube 112 such that an outer side portion 112T of the support tube 112 fits snugly between the vertical member 158 and the ribbed side of the socket 152, while an inner side portion 112N of the support tube 112 fits well between the vertical member 158 and the opposite side of the socket 152. A securing element 157A, such as a screw, is threaded through a hole 157 of the socket 152, the support tube 112, and the vertical member 158 and thus providing a firm secureness of the support tube 112 to the base support 15.

A through hole 125 is provided between the openings 121 of the inner plate 12 (see FIG. 1A) for allowing a protrusion 154 between the sockets 152 inserted through. Thereafter, a screw 156A is threaded through a U-shaped recessed member 156 to the protrusion 154 and thus providing a further firm secureness of the base support 15 to the luggage body 10 and the inner plate 12. Note that the width of a gap between the support tube 112 and the luggage body 10 is simply 1 mm, i.e., these two elements 112 and 10 are closely disposed, such that a wide gap deficiency of the prior art is eliminated by the present invention.

While the invention herein disclosed has been described by means of specific embodiments, numerous modifications and variations could be made thereto by those skilled in the art without departing from the scope of the invention set forth in the claims.

What is claimed:

1. A base support mechanism for a retractable handle of a wheeled luggage comprising:

a luggage body;

a pair of support tubes;

a pair of wheels;

a base support disposed on an exterior of the luggage body; and an inner plate provided on an interior of the luggage body;

wherein the inner plate has a pair of openings, the luggage body has a pair of openings provided on the lower portion thereof, the base support includes a horizontal portion and a vertical portion having a pair of sockets provided on an inner side thereof in which each socket is allowed to be inserted through a corresponding opening of the luggage body and a corresponding opening of the inner plate, each bottom of the support tubes is inserted into each socket, a securing element is inserted to secure each support tube to each socket, one wheel is secured to a side of the inner plate and the other wheel is secured to an opposite side of the inner plate.

2. The wheeled luggage of claim 1, wherein the sockets of the vertical portion of the base support are not in contact with the horizontal portion of the support.

3. The wheeled luggage of claim 1, wherein each bottom of the sockets of the vertical portion of the base support is not open.

4. The wheeled luggage of claim 1, wherein a vertical member within each socket of the vertical portion of the base support is extended upwardly from the bottom of each socket for providing a fit setting of an inner side of each support tube between each socket and the vertical member.

5. The wheeled luggage of claim 4, wherein a plurality of ribs are provided on an inner side of each socket which further forming a gap between a side of the vertical member and the inner side of each socket in which the width of the gap is approximately equal to a thickness of a wall of each support tube such that an outer side of each support tube fits snugly between the vertical member and the inner side of each socket.

6. The wheeled luggage of claim 1, wherein each support tube is positioned laterally adjacent to and by at most 1 mm to the luggage body.

* * * * *